US012042694B2

(12) United States Patent
Soroush

(10) Patent No.: US 12,042,694 B2
(45) Date of Patent: Jul. 23, 2024

(54) MULTI-PURPOSE EXERCISE EQUIPMENT

(71) Applicant: Alireza Soroush, Mclean, VA (US)

(72) Inventor: Alireza Soroush, Mclean, VA (US)

( * ) Notice: Subject to any disclaimer, the term of this patent is extended or adjusted under 35 U.S.C. 154(b) by 80 days.

(21) Appl. No.: 17/720,263

(22) Filed: Apr. 13, 2022

(65) Prior Publication Data

US 2022/0258001 A1 Aug. 18, 2022

Related U.S. Application Data

(60) Provisional application No. 63/149,648, filed on Feb. 15, 2021.

(51) Int. Cl.
*A63B 22/20* (2006.01)

(52) U.S. Cl.
CPC ..... *A63B 22/20* (2013.01)

(58) Field of Classification Search
CPC ... A63B 22/20; A63B 21/068; A63B 21/4034; A63B 21/4035; A63B 23/03541
See application file for complete search history.

(56) References Cited

U.S. PATENT DOCUMENTS

| | | | | |
|---|---|---|---|---|
| 3,403,906 | A * | 10/1968 | Burzenski | A63B 23/0211 482/108 |
| 6,328,680 | B1 * | 12/2001 | Shifferaw | A63B 21/0618 482/907 |
| 7,951,052 | B1 * | 5/2011 | Tang | A63B 22/20 482/132 |
| 9,132,315 | B1 * | 9/2015 | Chen | A63B 21/4049 |
| 9,174,082 | B1 * | 11/2015 | Marlow | A63B 23/1209 |
| 9,180,335 | B1 * | 11/2015 | Wu | A63B 23/0211 |
| 2002/0128130 | A1 * | 9/2002 | Miraflor | A63B 23/1245 482/141 |
| 2012/0100969 | A1 * | 4/2012 | Brodbeck | A63B 21/22 482/132 |
| 2016/0101314 | A1 * | 4/2016 | Exley | A63B 23/0211 482/132 |
| 2018/0056120 | A1 * | 3/2018 | Brown | A63B 21/4035 |

* cited by examiner

*Primary Examiner* — Andrew S Lo
(74) *Attorney, Agent, or Firm* — Jose W. Jimenez; Robert Cantrell; Jimenez Law Firm

(57) ABSTRACT

Described herein is multi-purpose exercise equipment. The first element of the inventive concept is equipped with adjustable bands coupled to a concave portion designed to fit the ball and toes of a user's foot and designed with a smooth outer face to slide on a surface. The second element of the inventive concept includes lockable handles, ergonomic grips, and rollable wheel members on each of two ends. The inventive concept may include a smartphone exercise app.

2 Claims, 16 Drawing Sheets

MULTI-PURPOSE EXERCISE EQUIPMENT

CLAIM OF PRIORITY

This application claims priority to and the benefit of U.S. Provisional Application Ser. No. 63/149,648, filed on Feb. 15, 2021, with the same title, which is herein incorporated by reference in its entirety.

FIELD OF THE INVENTION

The inventive concept relates generally to multi-purpose exercise equipment.

BACKGROUND

Currently, there are a number of solutions for exercise equipment. One of these solutions attempts to utilize dumbbells, but this solution fails to meet the needs of the market because dumbbells are unsuitable as rollers. Another solution is to use conventional rollers, but convention rollers fail to meet the needs of the market because conventional roller lack locks. Another solution attempts to utilize a plate and pully gym assembly, but this solution is similarly unable to meet the needs of the market because plate and pully gym assemblies can take up a lot of space. Still another solution seeks to utilize resistance bands, but this solution also fails to meet market needs because users can only use resistance bands for certain exercises. Therefore, there currently exists a need in the market for an improved apparatus that allows users to do multiple exercises.

SUMMARY OF THE INVENTION

A foot glider assembly for exercising has a concave polymer shell assembly with a substantially smooth bottom surface portion adapted to be worn over the ball and toes of a foot. A horizontal elastic strap member is coupled to right and left sides of an open distal end of the concave polymer shell assembly adapted to circumscribe the ankle of a foot. A vertical adjustable strap member is coupled to right and left sides of the open distal end of the concave polymer shell assembly adapted to circumscribe the instep of a foot. At least one silicone grip pad portion is disposed on a top surface of the concave polymer shell assembly.

The inventive concept as disclosed is designed to leverage a user's body weight and dynamics of body motion. Strap-on foot gliders adjust to fit all shoe sizes and will glide smoothly without friction on surfaces.

In one embodiment of the foot glider assembly, a digital instruction member is adapted to direct exercise.

Smooth in this inventive concept is defined as having minimal roughness as detectable by the touch of a typical person.

A handheld roller assembly for exercising has a distal wheel member and a proximal wheel member coupled by a substantially cylindrical handle assembly, the cylindrical handle assembly adapted to serve as an axel assembly and further defining a center axis of the wheel members and the cylindrical handle assembly. A wheel lock mechanism is disposed longitudinally within the cylindrical handle assembly comprising a rod member, a spring member disposed at a distal end of the rod member, and one or more pin members coupled to a proximal end of the rod member. The one or more pin members are each designed to be at least partially disposed within one of a plurality of socket members radially disposed around the center axis of the proximal wheel member when in a resting state. A hand lever member is longitudinally disposed on one side of the cylindrical handle assembly substantially equidistant between the distal wheel member and proximal wheel member, one or more spring members disposed on an interior side portion of the hand lever member designed, when in a resting state, to push outward from the center axis onto the hand lever member. At least one rod member protrusion member is opposed to at least one hand lever member protrusion member, opposed faces of the protrusion members slidably abutted at acute angles to the center axis wherein force applied inward toward the center axis is redirected perpendicularly as outward force to the rod member, the rod member compressing the spring member disposed on the distal end of the rod member as the one or more pin members disposed on the proximal end of the rod member are withdrawn from the plurality of socket members, thereby allowing the wheel members to rotate.

In one embodiment of the handheld roller assembly, a digital instruction member is designed to direct exercise. In one example embodiment, the spring-loaded brake release in the roller assembly triggers lock and unlocking of wheels on handle rollers for dynamic use and to provide less strain on joints. Unlocking of wheels includes pressing release in towards the handle and having locking pin move an axis pole away from the wheel to allow for radial movement. Axis pole re-engages the wheel when the brake release is released.

It would be advantageous to have multi-purpose exercise equipment that is universal. Furthermore, it would be advantageous to have multi-purpose exercise equipment that is adjustable. Still further, it would be advantageous to have multi-purpose exercise equipment that is smartphone compatible.

The inventive concept advantageously fills the aforementioned deficiencies by providing multi-purpose exercise equipment, which provides an effective way to exercise.

The multi-purpose exercise equipment fulfills the need for full body exercise equipment.

Among other things, it is an advantage of the inventive concept to provide multi-purpose exercise equipment that does not suffer from problems or deficiencies associated with prior solutions.

It is still further an advantage of the multi-purpose exercise equipment to be adjustable.

The inventive concept now will be described more fully hereinafter with reference to the accompanying drawings, which are intended to be read in conjunction with both this summary, the detailed description, and any preferred and/or particular embodiments specifically discussed or otherwise disclosed. This inventive concept may, however, be embodied in many different forms and should not be construed as limited to the embodiments set forth herein; rather, these embodiments are provided by way of illustration only and so that this disclosure will be thorough, complete and will fully convey the full scope of the inventive concept to those skilled in the art.

DETAILED DESCRIPTION OF THE INVENTION

Figure 1:
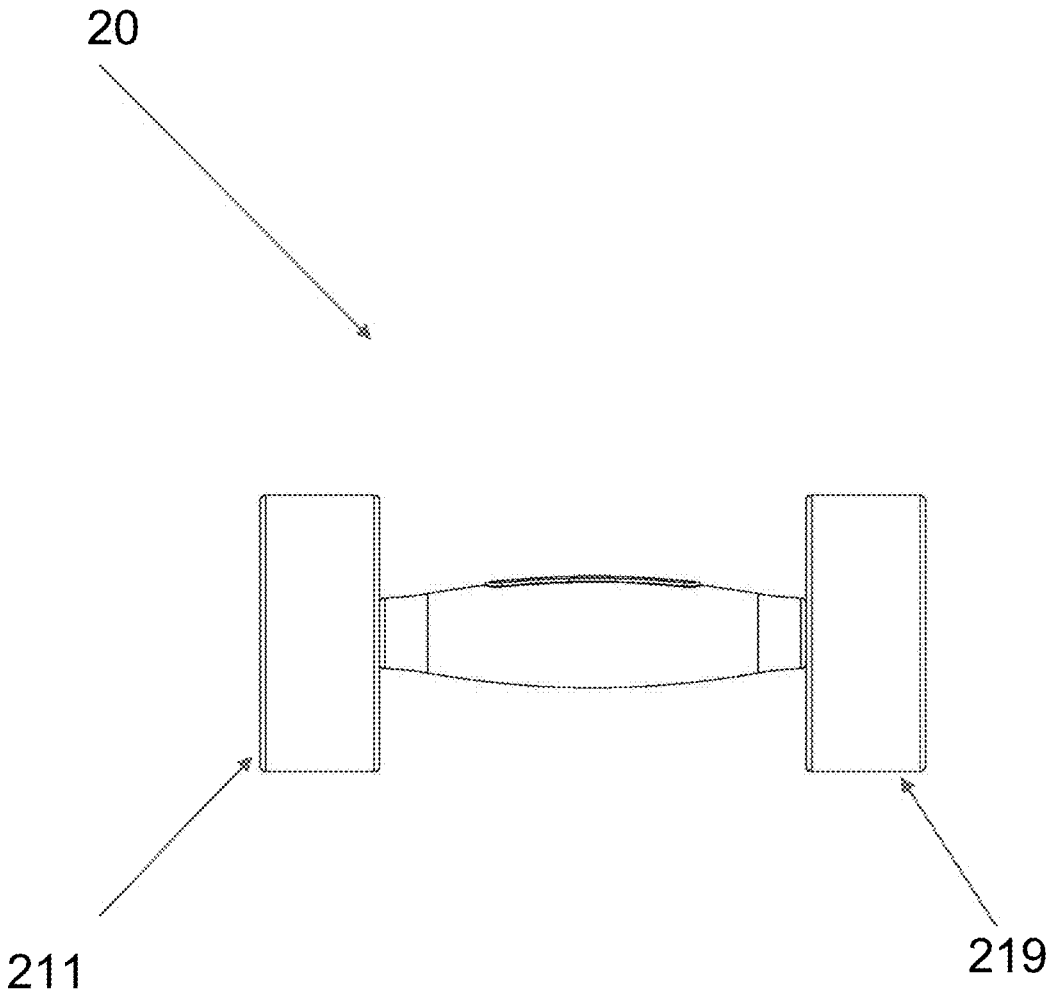
FIG. 1 illustrates the front of the rolling handle.
Figure 2:
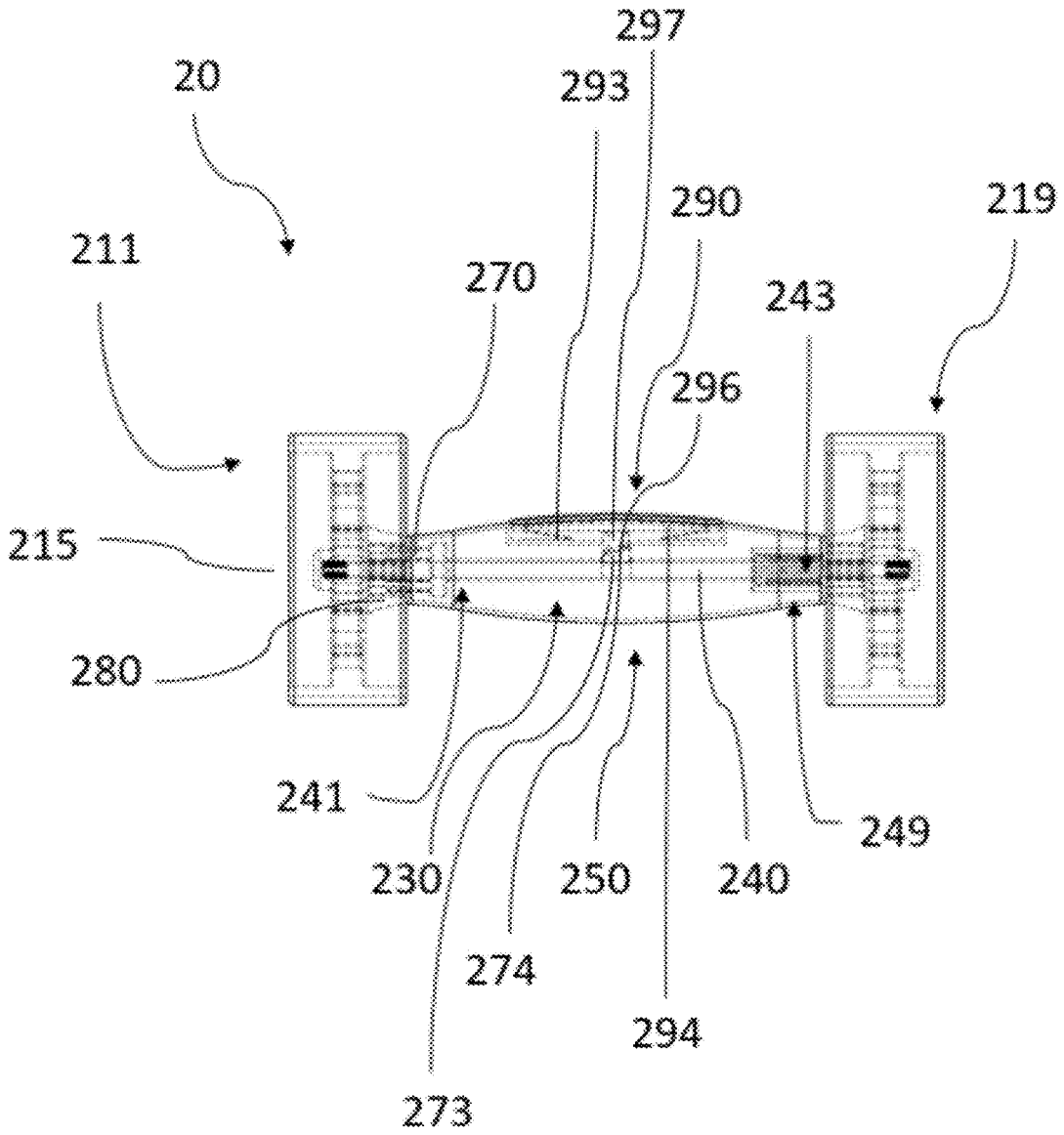
FIG. 2 illustrates the internal view of the rolling handle.
Figure 3:
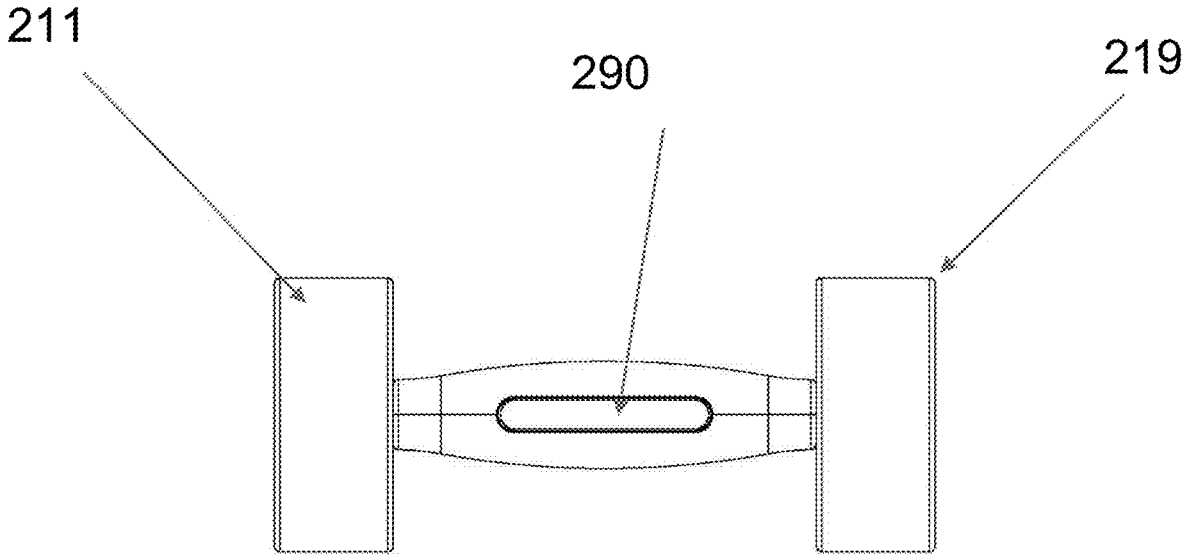
FIG. 3 illustrates the top of the rolling handle.
Figure 4:
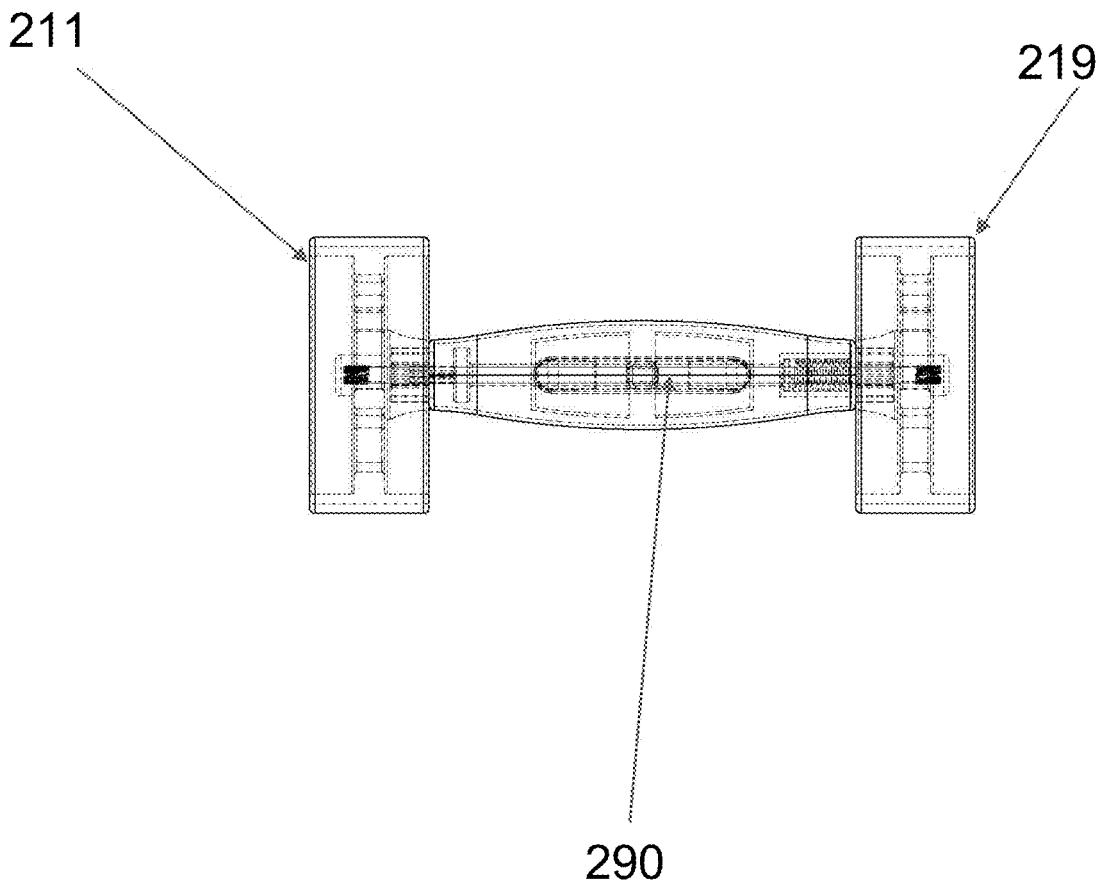
FIG. 4 illustrates the top internal view of the rolling handle.
Figure 5:
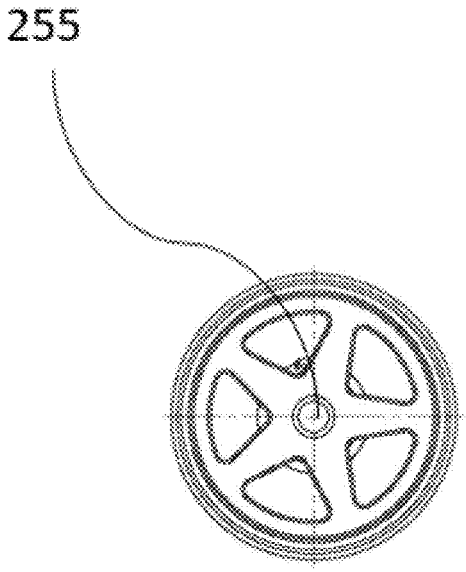
FIG. 5 illustrates the side of the rolling handle.
Figure 6:
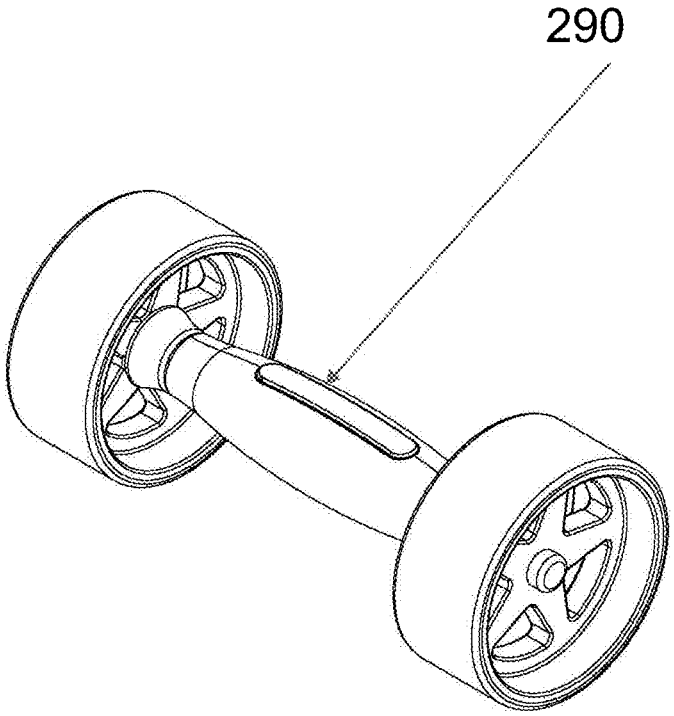
FIG. 6 illustrates the perspective view of the rolling handle.
Figure 7:
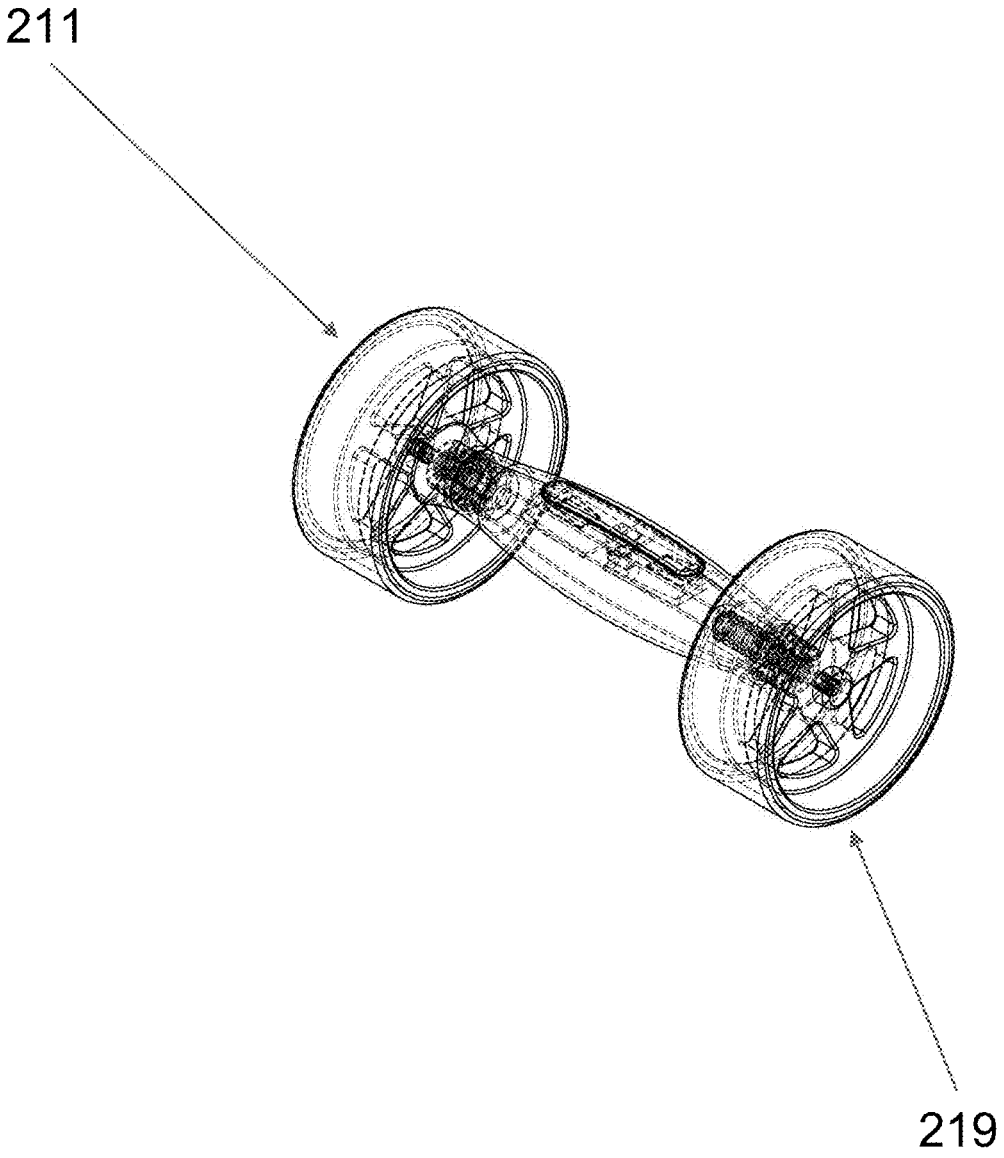
FIG. 7 illustrates the internal perspective view of the rolling handle.

Following are more detailed descriptions of various related concepts related to, and embodiments of, methods and apparatus according to the present disclosure. It should be appreciated that various aspects of the subject matter introduced above and discussed in greater detail below may be implemented in any of numerous ways, as the subject matter is not limited to any particular manner of implementation. Examples of specific implementations and applications are provided primarily for illustrative purposes.

Referring to the figures, FIGS. 1-8, a handheld roller assembly 20 for exercising has a distal wheel member 219 and a proximal wheel member 211 coupled by a substantially cylindrical handle assembly 250, the cylindrical handle assembly 250 designed to serve as an axel assembly and further defining a center axis of the wheel members 255 and the cylindrical handle assembly 250. A wheel lock mechanism 230 is disposed longitudinally within the cylindrical handle assembly comprising a rod member 240, a spring member 243 disposed at a distal end of the rod member 249, and one or more pin members 270 coupled to a proximal end of the rod member 241. The one or more pin members 270 are each designed to be at least partially disposed within one of a plurality of socket members 280 radially disposed around the center axis of the proximal wheel member 215 when in a resting state.

In this example embodiment, a hand lever member 290 is longitudinally disposed on one side of the cylindrical handle assembly 250 substantially equidistant between the distal wheel member 219 and proximal wheel member 211, one or more spring members 293 disposed on an interior side portion of the hand lever member 294 designed, when in a resting state, to push outward from the center axis 255 onto the hand lever member 290. At least one rod member protrusion member 273 is opposed to at least one hand lever member protrusion member 297, an opposed face of the rod protrusion member 274 and an opposed face of the hand lever member 296 abutted at acute angles to the center axis 255 wherein force applied inward toward the center axis 255 is redirected perpendicularly as outward force to the rod member 240, the rod member 240 compressing the spring member 243 disposed on the distal end of the rod member 249 as the one or more pin members 270 disposed on the proximal end of the rod member 241 are withdrawn from the plurality of socket members 280, thereby allowing the wheel members 211, 219 to rotate.

Figure 8:
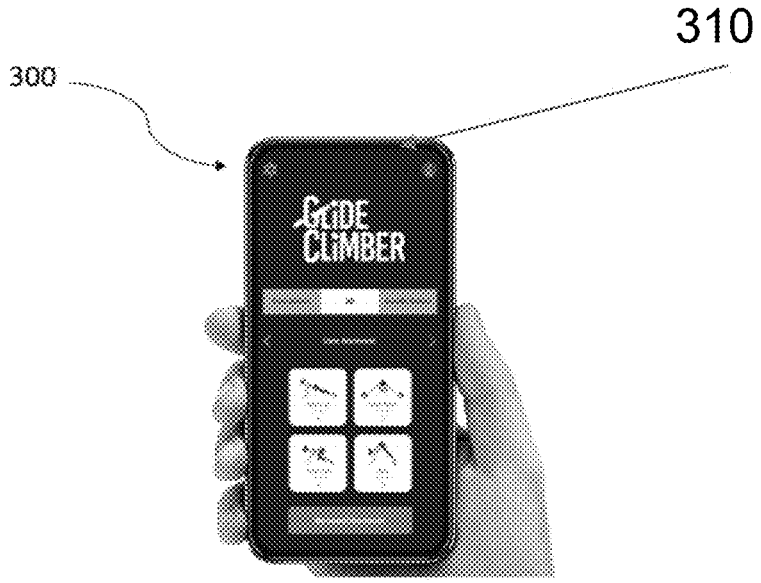
FIG. 8 illustrates the smartphone app.
Figure 9:
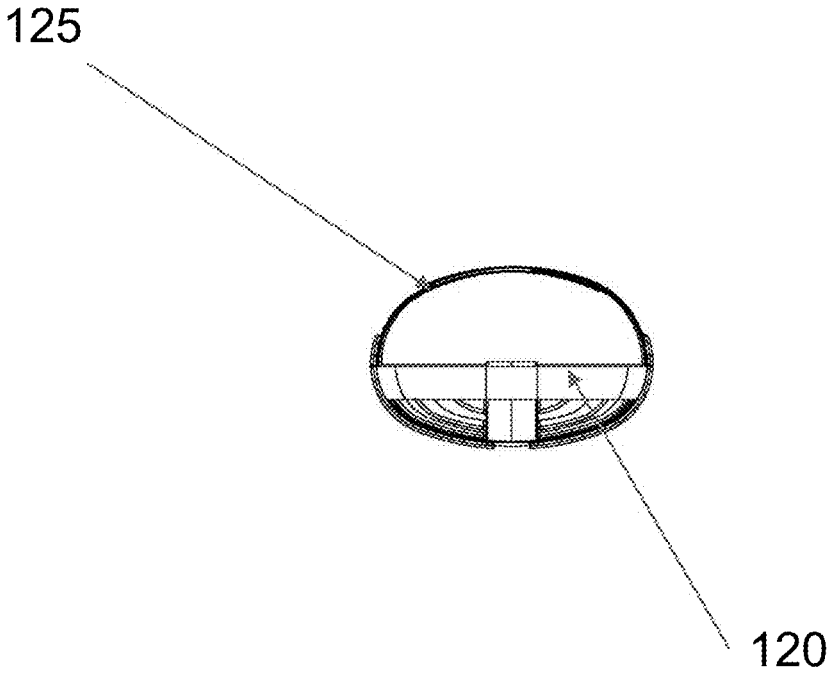
FIG. 9 illustrates the back view of the sliding foot.
Figure 10:
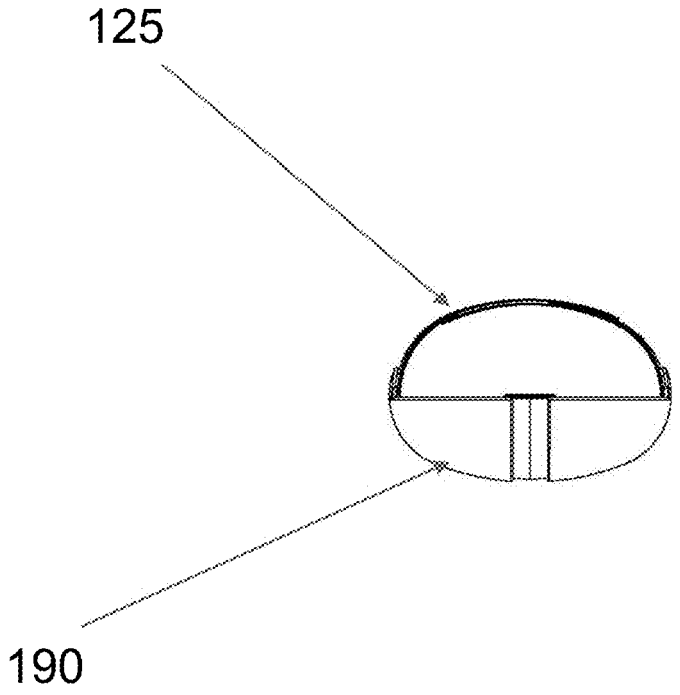
FIG. 10 illustrates the front view of the sliding foot.
Figure 11:
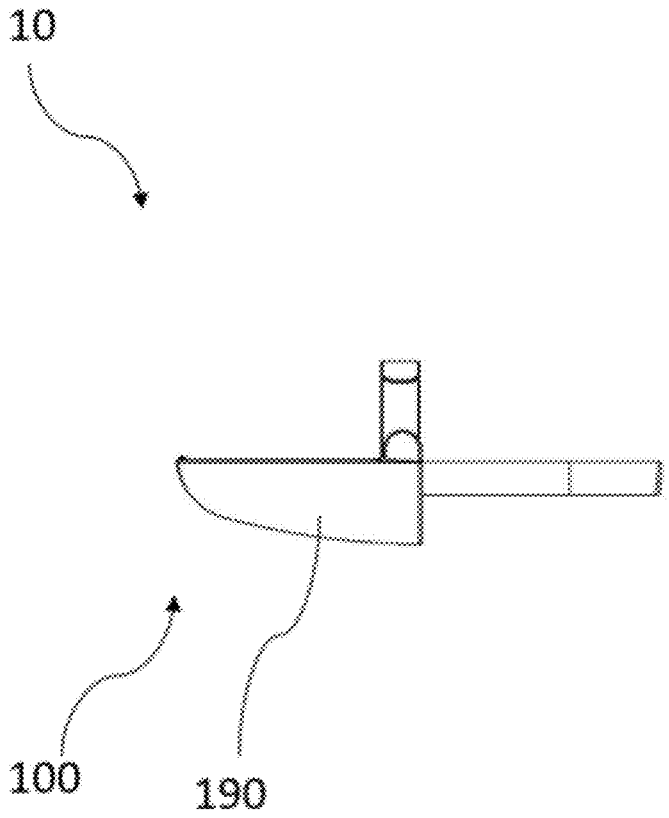
FIG. 11 illustrates the right side of the sliding foot.
Figure 12:
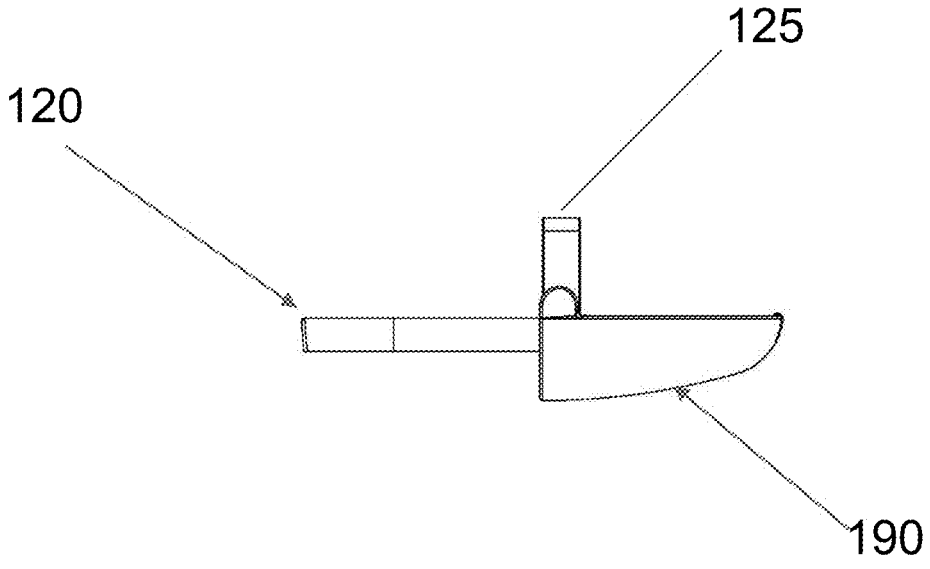
FIG. 12 illustrates the left side of the sliding foot.
Figure 13:
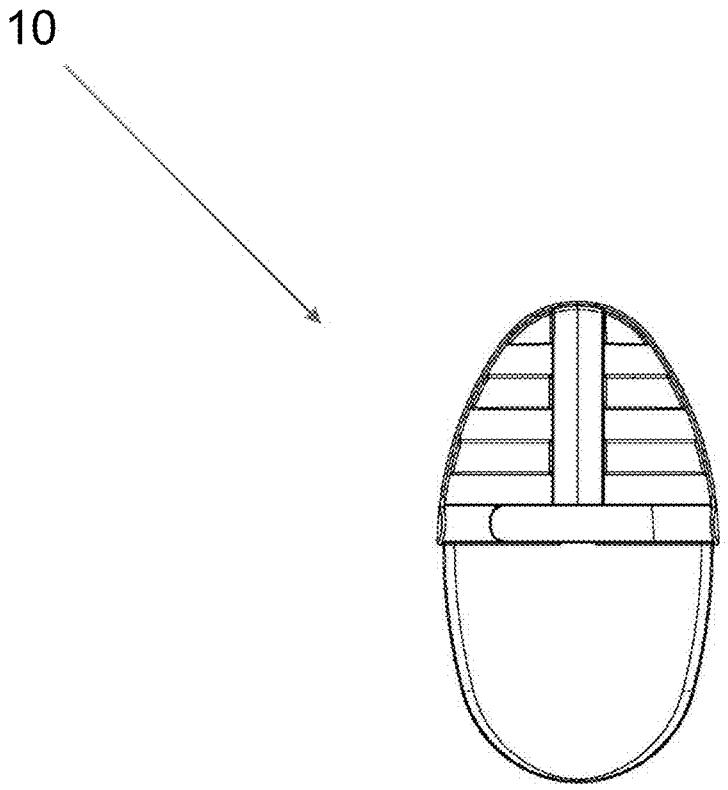
FIG. 13 illustrates the top view of the sliding foot.
Figure 14:
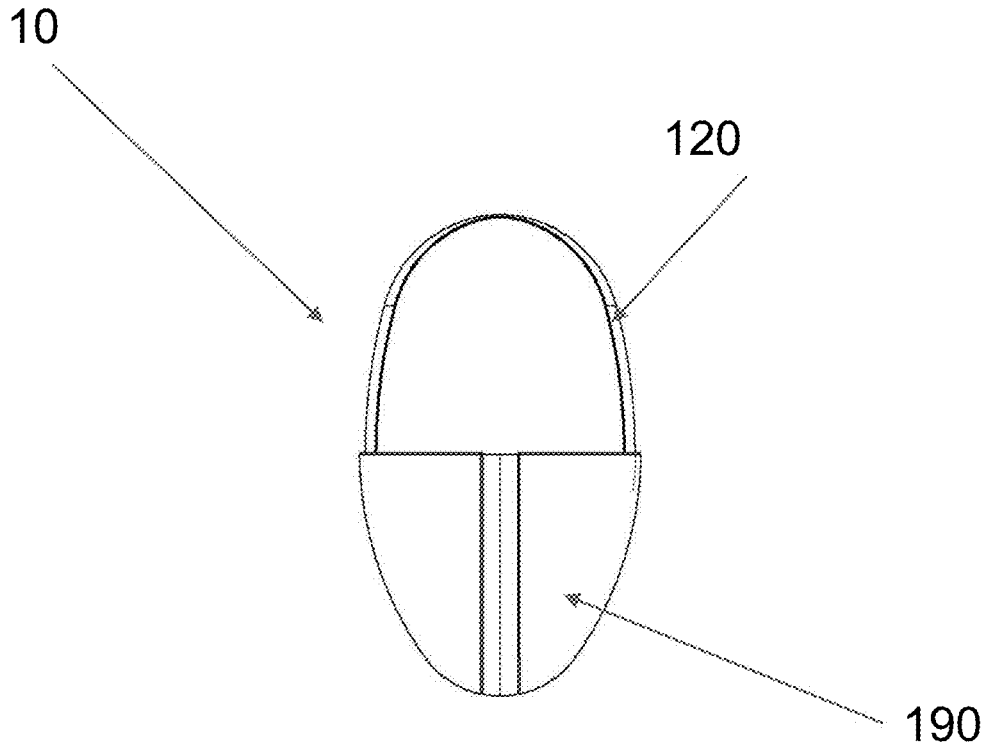
FIG. 14 illustrates the bottom of the sliding foot.
Figure 15:
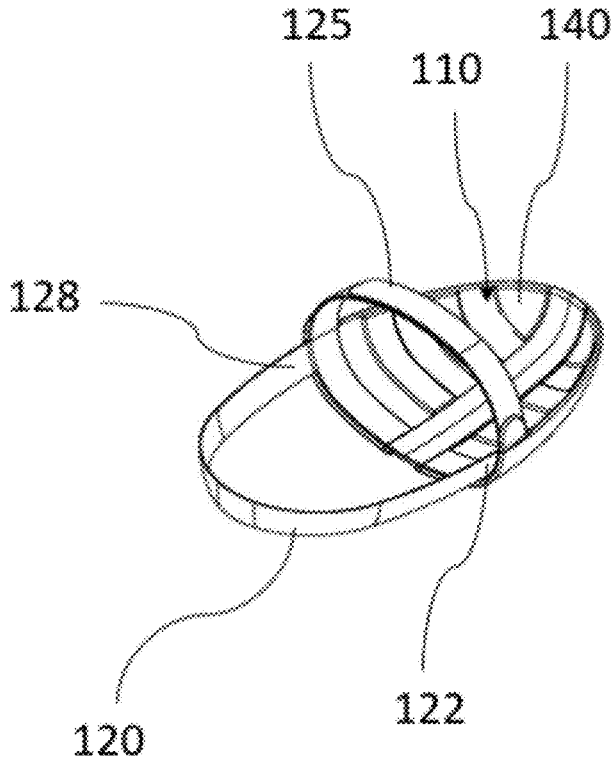
FIG. 15 illustrates the perspective view of the sliding foot.

Referring now to FIG. 8, in one embodiment of the handheld roller assembly 20, a digital instruction member 300 displayed on a smart device 310 (such as a smartphone or tablet) is designed to direct exercise not only for assembly 20 but also for foot glider assemblies described herein.

Referring to the figures, FIGS. 9-15 illustrate a foot glider assembly 10 for exercising has a concave polymer shell assembly 100 with a substantially smooth bottom surface portion 190 designed to be worn over the ball and toes of a foot. A horizontal elastic strap member 120 is coupled to a right side of an open distal end of the concave polymer shell assembly 122 and left side of an open distal end of the concave polymer shell assembly 128 designed to circumscribe the ankle of a foot. A vertical adjustable strap member 125 is coupled to a right side of the open distal end of the concave polymer shell assembly 122 and a left side of the open distal end of the concave polymer shell assembly 128 designed to circumscribe the instep of a foot. At least one silicone grip pad portion 140 is disposed on a top surface of the concave polymer shell assembly 110. In one embodiment of the foot glider assembly 10, a digital instruction member 300 is designed to direct exercise.

Figure 16:
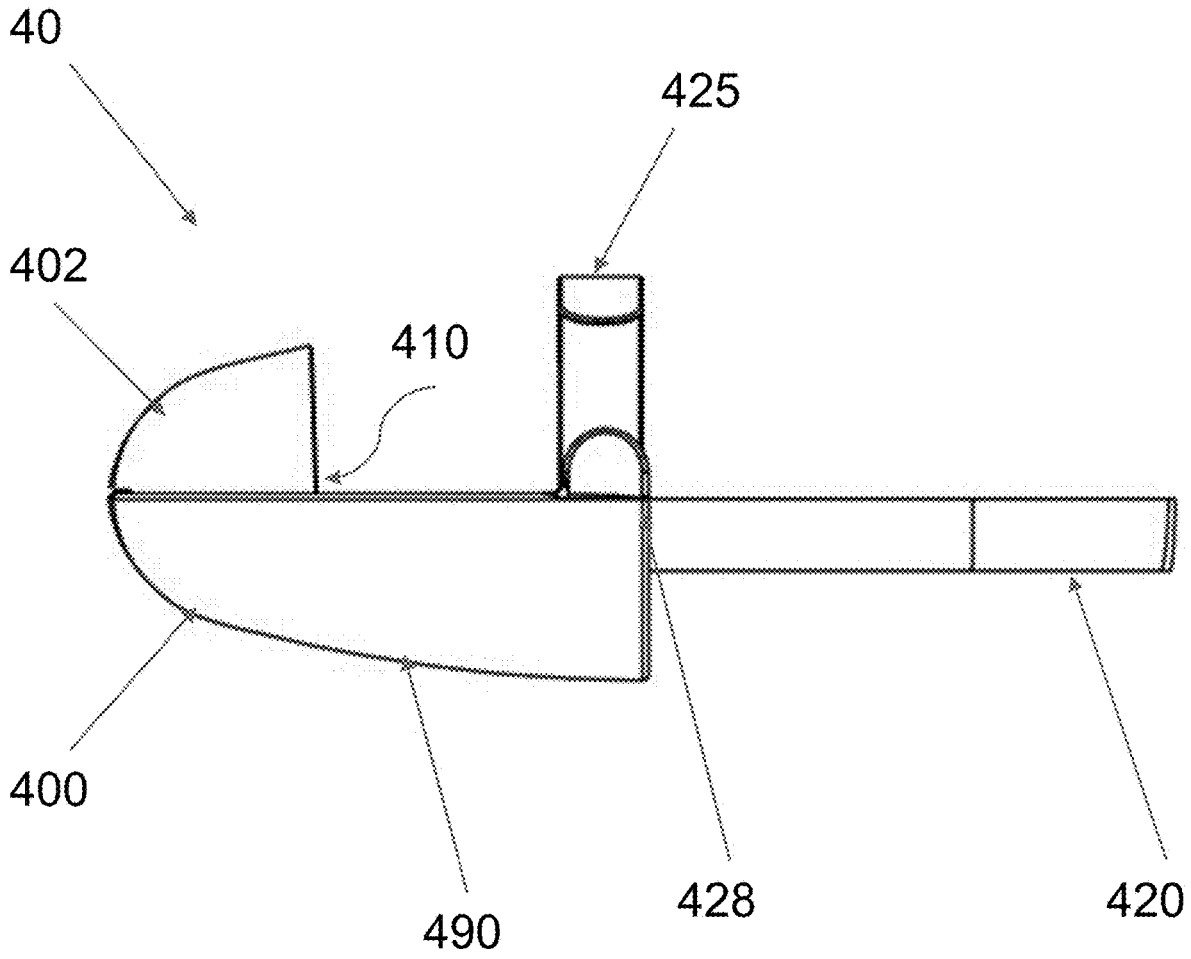
FIG. 16 illustrates a side view of another embodiment of a foot glider assembly.

Referring now to FIG. 16, there is illustrated a side view of another embodiment of a foot glider assembly 40 having a concave polymer shell assembly 400 with a cover member 402 and a substantially smooth bottom surface portion 490 designed to be worn over the ball and toes of a foot. A horizontal elastic strap member 420 is coupled to a right side of an open distal end 422 of the concave polymer shell assembly 400 and left side of an open distal end of the concave polymer shell assembly 428 designed to circumscribe the ankle of a foot. A vertical adjustable strap member 425 is coupled to a right side of the open distal end of the concave polymer shell assembly 422 and a left side of the open distal end of the concave polymer shell assembly 428 designed to circumscribe the instep of a foot. At least one silicone grip pad portion 440 is disposed on a top surface of the concave polymer shell assembly 410. In one embodiment of the foot glider assembly 40, a digital instruction member 300 is designed to direct exercise.

Various related embodiments of the inventive concept are envisioned such as cover member 402 having a half-shell configuration but in related embodiments includes a series of strips of silicone material that also form the half-shell configuration. Cover member 402 improves the fit and gripping to a user's foot or feet can be made from silicone or cloth or other material that allows for some expansion and stretching.

The following patents are incorporated by reference in their entireties: U.S. Pat. Nos. 2014/0221164, 4,249,727, and CN103610235A. While the inventive concept has been described above in terms of specific embodiments, it is to be understood that the inventive concept is not limited to these disclosed embodiments. Upon reading the teachings of this disclosure, many modifications and other embodiments of the inventive concept will come to mind of those skilled in the art to which this inventive concept pertains, and which are intended to be and are covered by both this disclosure and the appended claims. It is indeed intended that the scope of the inventive concept should be determined by proper interpretation and construction of the appended claims and their legal equivalents, as understood by those of skill in the art relying upon the disclosure in this specification and the attached drawings.

The invention claimed is:

1. A handheld roller assembly for exercising comprising:

a distal wheel member and a proximal wheel member coupled by a substantially cylindrical handle assembly, the cylindrical handle assembly adapted to serve as an axel assembly and further defining a center axis of the wheel members and the cylindrical handle assembly;

a wheel lock mechanism disposed longitudinally within the cylindrical handle assembly comprising a rod member, a spring member disposed at a distal end of the rod member, and one or more pin members coupled to a proximal end of the rod member, the one or more pin members each adapted to be at least partially disposed within one of a plurality of socket members radially disposed around the center axis of the proximal wheel member when in a resting state;

a hand lever member longitudinally disposed on one side of the cylindrical handle assembly substantially equidistant between the distal wheel member and proximal wheel member, one or more spring members disposed on an interior side portion of the hand lever member adapted, when in a resting state, to push outward from the center axis onto the hand lever member; and at least one rod member protrusion member opposed to at least one hand lever member protrusion member, opposed faces of the protrusion members slidably abutted at acute angles to the center axis wherein force applied inward toward the center axis is redirected perpendicularly as outward force to the rod member, the rod member compressing the spring member disposed on the distal end of the rod member as the one or more pin members disposed on the proximal end of the rod member are withdrawn from the plurality of socket members, thereby allowing the wheel members to rotate.

2. The handheld roller assembly for exercising of claim 1, wherein a digital instruction member is adapted to direct exercise.

* * * * *